US005463789A

United States Patent [19]

Zilinski

[11] Patent Number: 5,463,789

[45] Date of Patent: Nov. 7, 1995

[54] PAINT ROLLER BUMPER

[76] Inventor: Stanley H. Zilinski, 420 Porter St., Easton, Pa. 18042

[21] Appl. No.: 151,418

[22] Filed: Nov. 12, 1993

[51] Int. Cl.[6] ..... B44D 3/28

[52] U.S. Cl. ..... 15/248.2; 15/230.11

[58] Field of Search ..... 15/230.11, 248.2

[56] References Cited

U.S. PATENT DOCUMENTS

| | | | |
|---|---|---|---|
| 2,763,022 | 9/1956 | Glacken | 15/248.2 |
| 3,112,729 | 12/1963 | Prezioso | 15/230.11 |
| 3,175,241 | 3/1965 | Singleton et al. | 15/248.2 |
| 3,369,269 | 2/1968 | Deck et al. | 15/230.11 |
| 3,623,180 | 11/1971 | Anderson | 15/248.2 X |
| 3,654,658 | 4/1972 | Kovacs . | |
| 3,685,084 | 8/1972 | Bennett | 15/248.2 X |
| 3,790,984 | 2/1974 | Spransy et al. | 15/248.2 X |
| 4,091,493 | 5/1978 | Weiss . | |
| 4,528,712 | 7/1985 | Leibow | 15/230.11 X |
| 4,564,970 | 1/1986 | Latraverse | 15/248.2 X |
| 4,599,762 | 7/1986 | Rigter | 15/248.2 |

*Primary Examiner*—Chris K. Moore

*Attorney, Agent, or Firm*—Kenneth P. Glynn; Gina M. Gualtieri

[57] ABSTRACT

The present invention is directed to a paint roller bumper for a paint roller device. It is specifically for such a device which has a handle, an extended, curved rod and a roller. The curved rod extends from the handle with a lower portion extending directly away from the handle, a middle portion extending away from the lower portion, an upward portion extending from said middle portion in a direction which is at a right angle from a roller, and a top portion extending from the upward portion, as well as a roller rotatably mounted on the top portion of the rod. The bumper has a main bumper body with a lower section and an upper section and has adequate length so as to extend beyond the mounted roller on the described paint roller device when the bumper is mounted on an upward portion of a rod of such a paint roller device. It also includes attachment means, such as clips, connected to the main bumper body and adapted to attach the bumper to an upward portion of a rod of a paint roller device so as to establish an angle between the upper section of the main bumper body and the upward portion of the rod of at least 30 degrees, and, preferably, at least 45 degrees. In preferred embodiments, the bumper of the present invention may be unistructurally formed so that the attachment means and the main bumper body are cast or otherwise formed as a single unit.

18 Claims, 2 Drawing Sheets

PAINT ROLLER BUMPER

BACKGROUND OF THE INVENTION

1. Field of the Invention

The present invention relates to paint rollers in general, and, more particularly, to a bumper device for paint rollers which are formed of a handle, a configured rod and a roller. The bumper is set at a predetermined angle relative to the paint roller devise so as to not interfere with the rolling motion but so as to prevent a roller from contacting a ceiling or other surface which is in a 90 degree plane with the surface being painted.

2. Information Disclosure Statement Paint roller shields and the like have been developed over the years, but not in the form of the present invention devise.

For example, U.S. Pat. No. 4,091,493 issued to Nathan Weiss on May 30, 1978 describes a paint roller using a conventional nap-type of roller which is rotatably mounted on an offset handle. The invention includes a shield which has a center part which has hingedly secured front and back sections. Elastic bands are employed on each end of the housing to hold together the front and back sections to the center part when in operation. The elastic bands function to connect the shield to the paint roller structure. In the shielding position, the housing surrounds the paint roller to intercept the paint spray. When the roller is removed from the painted surface, the shield is free to pivot to catch droplets that would otherwise fall to the floor. An adjustable adaptor assembly is employed on each end of the housing to permit the shield to be employed with rollers of different nap thicknesses. A roller assembly is connected to both the front and back parts so that the devise, when in use, will role with low fictional on the surface to be painted thereby not permitting the shield itself to come into contact with the painted surface.

U.S. Pat. No. 3,65.4,658 is directed to a splatter shield and bumper for a paint roller. This invention covers a device made up of a shield of light-weight material which can be clipped to the spindle holding the paint cylinder of a paint roller, and a clamp which can be affixed to the handle of a paint roller. The clamp has a rotatable plate affixed to it which plays as a finger portion for rotation of the plate. The rotational plate and the shield are linked together by guide-lines which permit rotation of the shield to the desired position by mere finger pressure on the rotatable plate as the roller is being used.

U.S. Pat. No. 3,623,180 issued on Oct. 31, 1969 to Robert L. Anderson describes a non-smearing guard for attachment to the respective outward ends of an axle and a complimentary free-turning axle-supported striping-type paint roller. This attachment comprises an elongated protectively coated plate of prescribed size and shape the median portion of the inward attachable side of which is detachably and adjustably mounted on a pocket enclosed but accessible end of the axle. Equipped with this guard, the roller can be guidingly push-pulled along a sidewall surface proximal to the ceiling without smearing paint on the ceiling.

While the aforesaid prior art does describe shields and guards and bumpers for rollers, these guards are not attachable to the upward section of a rod and are not used for vertical motion of a roller to prevent such a roller from striking the ceiling above. In fact, the structure of the present invention is different from and much more simplified than the complex cumbersome commercially unacceptable devices described heretofore.

SUMMARY OF THE INVENTION

The present invention is directed to a paint roller bumper for a paint roller device. It is specifically for such a device which has a handle, an extended, curved rod and a roller. The curved rod extends from the handle with a lower portion extending directly away from the handle, a middle portion extending away from the lower portion, an upward portion extending from said middle portion in a direction which is at a right angle from a roller, and a top portion extending from the upward portion, as well as a roller rotatably mounted on the top portion of the rod. The bumper has a main bumper body with a lower section and an upper section and has adequate length so as to extend beyond the mounted roller on the described paint roller device when the bumper is mounted on an upward portion of a rod of such a paint roller device. It also includes attachment means, such as clips, connected to the main bumper body and adapted to attach the bumper to an upward portion of a rod of a paint roller device so as to establish an angle between the upper section of the main bumper body and the upward portion of the rod of at least 30 degrees, and, preferably, at least 45 degrees. In preferred embodiments, the bumper of the present invention may be unistructurally formed so that the attachment means and the main bumper body are cast or otherwise formed as a single unit.

BRIEF DESCRIPTION OF THE DRAWINGS

The present invention will be more fully understood when the drawings appended hereto are taken in conjunction with the specification herein. These drawings are.

DETAILED DESCRIPTION OF THE PRESENT INVENTION

Figure 1:
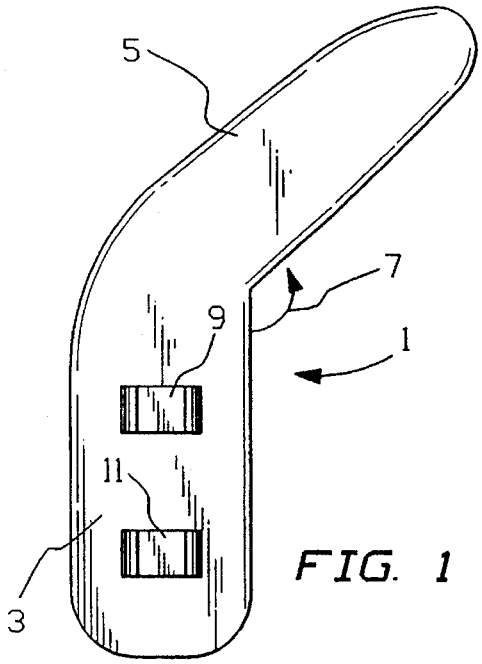
FIG. 1 which shows a side view of one embodiment of the present invention bumper device.

As mentioned above, the present invention is a paint roller bumper for attachment to a roller device which has a handle, a curved rod and a roller. Typically, the paint roller device to which the present invention is attached has a plastic or wooden handle and extending from the handle in the same direction and plane as the handle itself is a rod which may be flat or circular but extends so as to form a series of right angles. In the typical commercially available roller devices of this type, the rod extends first from the handle in the same direction and plane and then to the right or left at right angles from the lower portion to form a middle portion, and then at right angles in the opposite direction to form an upward section which generally runs parallel to the ends of the roller, and finally is curved again at a right angle so as to itself be the main axle or spindle receiver for a roller. The present invention bumper is attached to what is referred to herein as the upward portion, that is the portion of the rod which runs parallel to the end of the roller and at a right angle to the portion of the rod which contains the roller. (For simplicity herein, the word "roller" is used to mean the wire-spindle which is attached to the rod, as well as the cardboard or plastic cylinder as well as the felt or other nap which is attached to the cylinder.) The paint roller bumper extends beyond a mounted roller on a paint roller device, in a direction away from the longitudinal axis of the mounted roller.

The bumper itself may be made of plastic or metal or pressed paperboard or other paper or cellulistic product or could even be made of wood. However, plastic and stiff paperboard and slurry cardboard bumpers would be most economic and could be reused or disposable. The attachment means may be clips, slots, grooves or even more sophisticated attachment means which would be known to the artisan for attachment of light-weight to a rod-like material, but clips or slots are preferred in some embodiments and may be unistructurally formed with the main bumper body itself. Alternatively, a coiled wire or wire-like material could be used, either in the form of a spiral or a series of "C" open ringlets to enable a bumper to be "screwed" spirally onto a rod or snapped onto a rod where the open "C" segments establish a snap-on feature.

The present invention bumper may be flat or not and may be made of plate material or curvilinearly formed and made be on a single plane or plurality of planes. It may be formed of solid material or hollow material and may be formed of wire or rod stock, as well. It may be in a single plane or in a plurality of planes and it may be formed of a series of flat pieces with varying angles to achieve the desired result. However, some critical aspects should be noted. First, there would be an upper section and a lower section and the lower section would be the location of attachment and the upper section would be the working section which would actually come into contact with a ceiling or other surface and bump it to basically stop any further movement in the direction of the bumper and would thereby prevent contact of a paint-wet roller with a surface which a user would not want to receive paint.

One critical feature of the present invention is to permit a device to be attached directly to the upward portion of the rod of a paint roller device. Unlike prior art devices, there would be no need to utilize the rollers, roller spindles, or the rod where the spindles are mounted nor would the present invention device be affixed to both ends of the spindle or spindle rod so as to encompass the roller itself.

Figure 2:
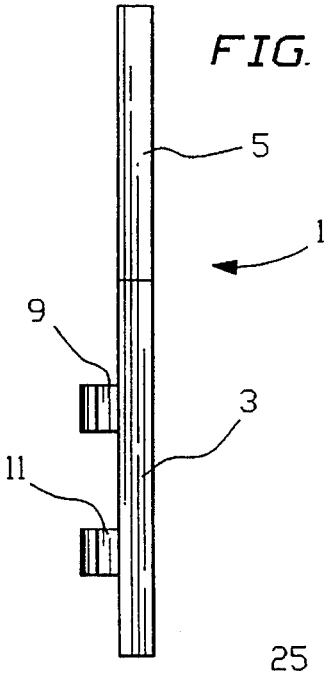
FIG. 2 which shows a front view of the device shown in FIG. 1.

Referring now to FIG. 1, there is shown a side view of the present invention paint roller bumper 1. This includes lower section 3 of the main bumper body and upper section 5 of the main bumper body. There is an angle formed between lower section 3 and upper section 5 which is at least 30 degrees and is, in preferred embodiments, at least 45 degrees. While this angle is measured as between lower section 3 and upper section 5, it should be noted that the importance of such an angle is relevant to the present invention only because attachment means clips 9 and 11 run parallel to the sides of lower section 3. This enables bumper 1 to be attached to a portion of a rod of a paint roller device so that bumper 1 forms an angle of at least 30 degrees with the rod portion at its upper section 5 of the main bumper body. In other embodiments, the upper section and lower sections of the bumpers may be formed in a straight line and a single plane and the attachment means may then be positioned at a predetermined angle with respect to a straight line main bumper body to achieve an angle of at least 30 degrees and preferably of at least 45 degrees with respect to an upward portion of a paint roller device. FIG. 2 shows a front view of the present invention bumper 1 shown in FIG. 1 and identical parts are identically numbered. This Figure illustrates that bumper 1 may be formed of flat plate material, as shown.

Figure 3:
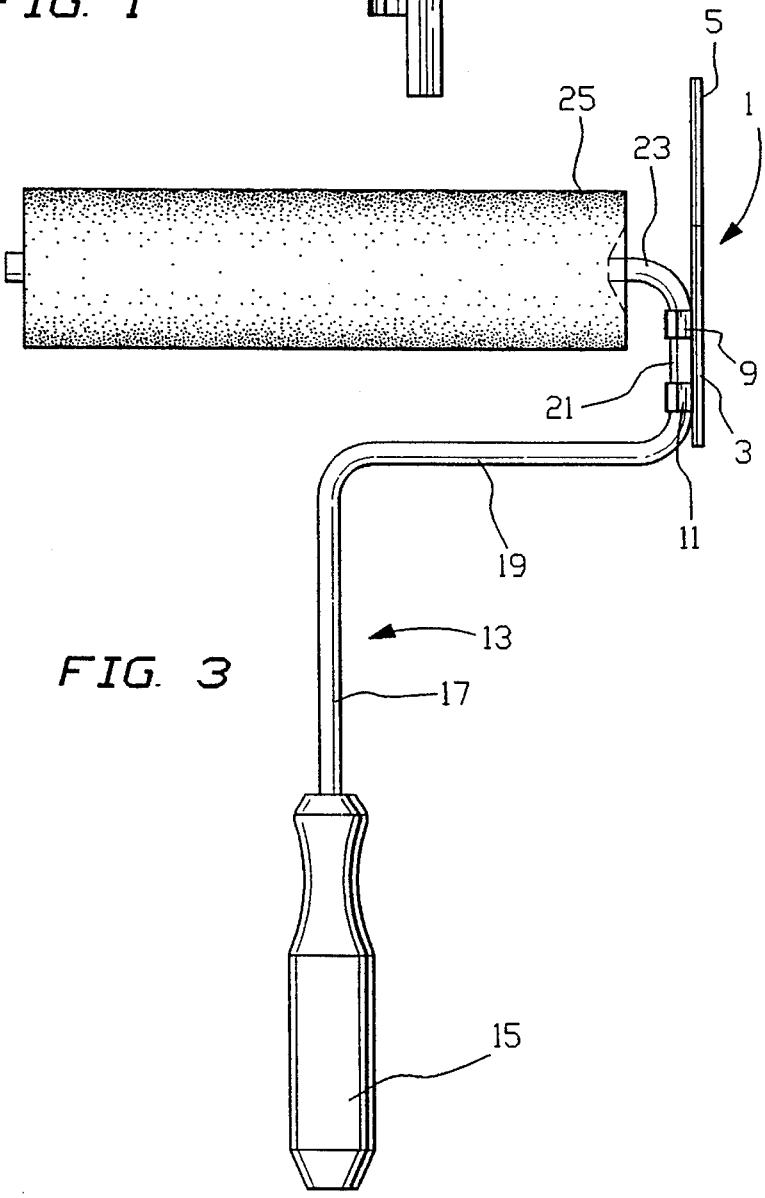
FIG. 3 which shows a front view of a paint roller device with a present invention bumper attached thereto.

Referring now to FIG. 3, there is shown a front view of paint roller device 13 and present invention bumper 1. Paint roller device 13 includes a handle 15 and a curved rod which includes a lower portion 17 which travels away from and in the same direction as handle 15 is pointed, a middle portion 19 which turns at a right angle away from lower portion 17, an upward portion 21 which turns at a right angle in the opposite direction away from middle portion 19 and runs in the same plane as lower porton 17 but aside and away from it, followed by top portion 23 which is at right angles to upward portion 21. Top portion 23 extends through roller 25 which may include a spindle and a hard cylinder under the nap ( not shown ) . Here, bumper 1 is clipped onto upward portion 21 via attachment means clips 9 and 11 and upper section 5 thereof extends beyond the height of roller 25. Further, as a user holds handle 15 and faces the paper or faces FIG. 3, upper section 5 would extend toward the user and away from a wall against which roller 25 may be rolled to apply paint.

Figure 4:
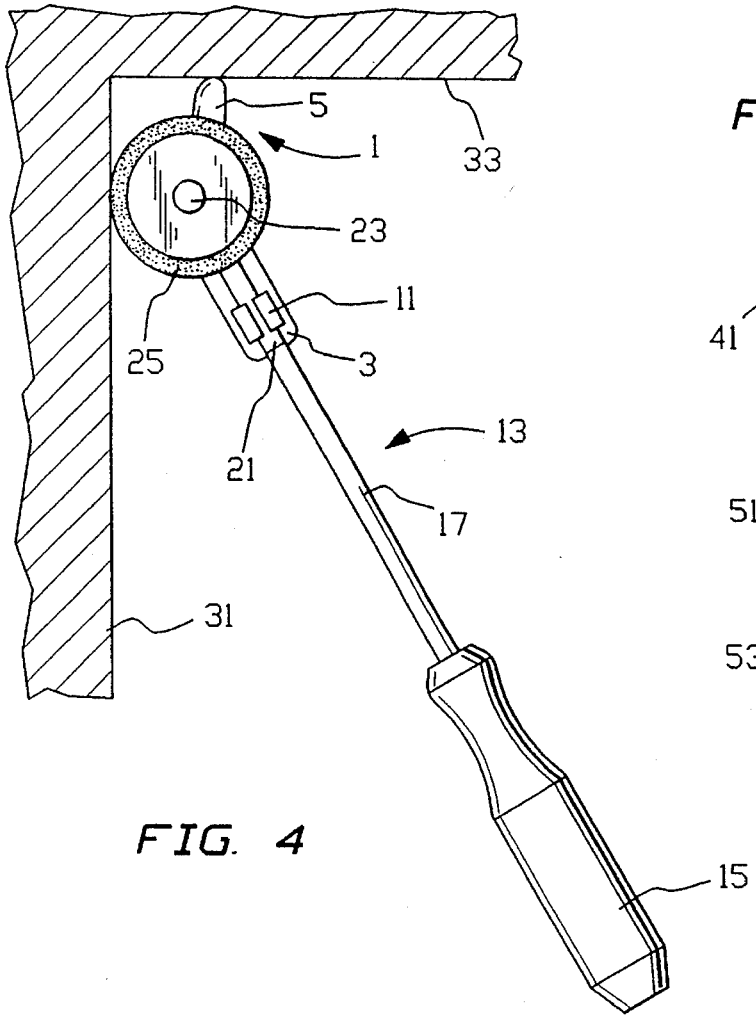
FIG. 4 which shows a side view of the device and bumper shown in FIG. 3.

Referring now to FIG. 4, there is a side view of the present invention bumper 1 and paint roller device 13 which are shown together in FIG. 3. Here, the side view shows roller 25 against wall 31 for applying paint and paint roller device 13 is at its upper most possible position because upper section 5 of bumper 1 has come into contact ceiling 33 to prevent roller 25 from contacting ceiling 33 and thereby preventing any paint on roller 25 from touching ceiling 33.

Figure 5:
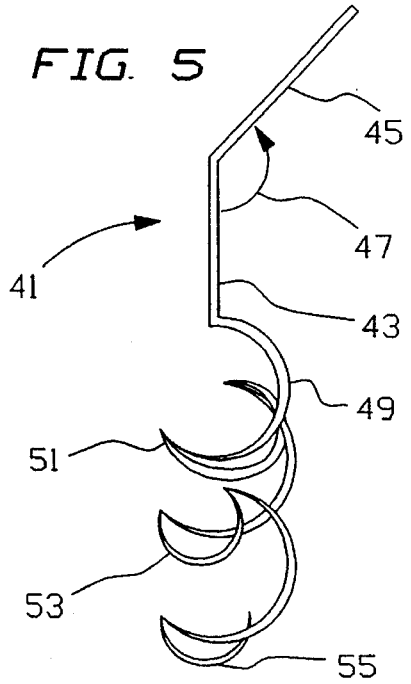
FIG. 5 which shows a side view of an alternative present invention device formed of wire-like material.

FIG. 5 shows a side view of an alternative present invention device made of wire-like material. Herein, bumper 41 has an upper section 45 and a lower section 43 with an angle created therebetween shown by angle arrow 47. This angle would be at least 30 degrees and preferably at least 45 degrees. Additionally, the lower section 43 includes a partially wound section 49 which includes open "C" sections 51, 53 and 55 to create a unistructurally formed, snap-on type bumper.

Figure 6:
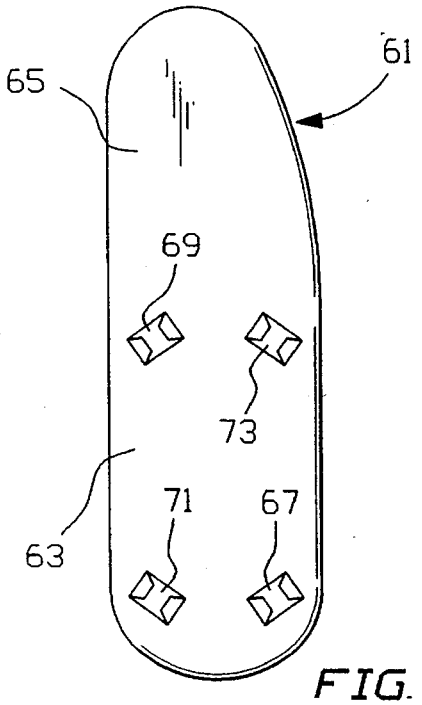
FIG. 6 which shows another alternative embodiment present invention bumper device having a plurality of attachment means for attachment in more than one positio-n;and, FIG. 7 which shows a slurry paperboard (cellulosic) bumper of the present invention.

FIG. 6 shows a front view of yet another alternative embodiment present invention bumper. Here, bumper 61 includes lower section 63 and upper section 65. These are formed in as straight line and a single plane and also have two sets of attachment means. Thus, clips 67 and 69 may be used to tilt or angle bumper 61 relative to an upward portion of a rod on a paint roller device and, alternatively, clips 71 and 73 may be used for the same purpose. Thus, a user could literally turn a paint roller device around and remove bumper 61 and reattach it in a different position so that it would still be functional.

Figure 7:
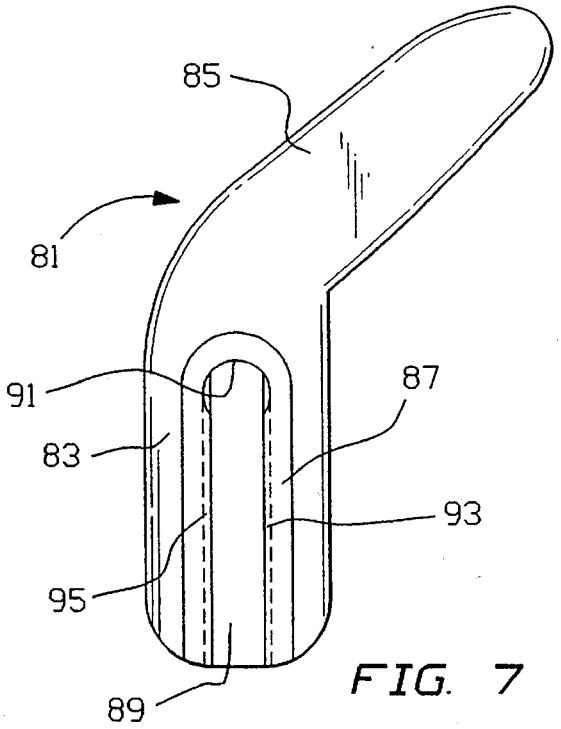

FIG. 7 shows a front view of a present invention bumper 81, which is made of molded cellulosic product, in this case, from slurry board or molded cardboard. It includes a lower section 83 and an upper section 85 with a predetermined angle in between. Additionally, there is an extended section 87 which has an opening 89 for a snap fit over the upper most aspect of an upward portion of a rod on a paint roller device. Arc 91 acts as a stop and lips 95 and 93 would act to hold bumper 81 in place. Thus, bumper 81 may be pushed down from over the top of an upward portion of a rod of a paint roller device to be snugly fitted thereon and this embodiment could be reused or it could be disposable as maybe desired.

Obviously, numerous modifications and variations of the present invention are possible in light of the above teachings. It is therefore understood that within the scope of the appended claims, the invention may be practiced otherwise than as specifically described herein.

What is claimed is:

1. A paint roller bumper for a paint roller device having a handle, an extended, curved rod extending from the handle with a lower portion extending directly away from said handle, a middle portion extending away from said lower portion, an upward portion extending from said middle portion in a direction which is a right angle from a roller, and a top portion of said rod, which comprises:

(a) a main bumper body having a lower section and an upper section and having adequate length so as to extend beyond a mounted roller in a direction away from said roller on a paint roller device when said bumper is mounted on an upward portion of a rod of a paint roller device; and, (b) attachment means connected to said main bumper body and attaching said bumper to an upward portion of a rod of a paint roller device so as to establish an angle between the upper section of the main bumper body and the upward portion of the rod of at least 30 degrees.

2. The paint roller bumper of claim 1 wherein said main bumper body is formed of a wire-like material.

3. The paint roller bumper of claim 2 wherein a segment of said wire-like material is coiled to form said attachment means.

4. The paint roller bumper of claim 3 wherein said upper section and said lower section are located in a single plane and in a straight line and said attachment means are positioned so as to create the aforesaid angle between said upper section of the main bumper body and the upward portion of the rod.

5. The paint roller bumper of claim 4 wherein said angle is at least 45 degrees.

6. The paint roller bumper of claim 1 wherein said main bumper body is a molded material.

7. The paint roller bumper of claim 6 wherein the molded material is selected from the group consisting of plastics, metals and cellulosic products.

8. The paint roller bumper of claim 7 wherein said attachment means is at least one snap-fit groove.

9. The paint roller bumper of claim 6 wherein said attachment means is at least one snap-fit groove.

10. The paint roller bumper of claim 9 wherein said attachment means is integrally formed with said main bumper body.

11. The paint roller bumper of claim 1 wherein said main bumper body is formed of a flat plate material.

12. The paint roller bumper of claim 1 wherein said upper section and said lower section are established to form an angle of at least 30 degrees between one another.

13. The paint roller bumper of claim 1 wherein there are a plurality of attachment means that enable attachment of said bumper to an upward portion of a rod of a paint roller device in more than one position.

14. A paint roller bumper for a paint roller device having a handle, an extended, curved rod extending from the handle with a lower portion extending directly away from said handle, a middle portion extending away from said lower portion, an upward portion extending from said middle portion in a direction which is a right angle from a roller, and a top portion of said rod, which comprises:

(a) a main bumper body having a lower section and an upper section and having adequate length so as to extend beyond a mounted roller in a direction away from a longitudinal axis of said roller on a paint roller device when said bumper is mounted on an upward portion of a rod of a paint roller device, said main bumper body being formed of a wire-like material; and, (b) attachment means connected to said main bumper body and adapted to attach said bumper to an upward portion of a rod of a paint roller device so as to establish an angle between the upper section of the main bumper body and the upward portion of the rod rod of at least 30 degrees.

15. The paint roller bumper of claim 14 wherein a segment of said wire-like material is coiled to form said attachment means.

16. A paint roller bumper for a paint roller device having a handle, an extended, curved rod extending from the handle with a lower portion extending directly away from said handle, a middle portion extending away from said lower portion, an upward portion extending from said middle portion in a direction which is a right angle from a roller, and a top portion of said rod, which comprises:

(a) a main bumper body having a lower section and an upper section and having adequate length so as to extend beyond a mounted roller in a direction away from a longitudinal axis of said roller on a paint roller device when said bumper is mounted on an upward portion of a rod of a paint roller device; and, (b) attachment means connected to said main bumper body and adapted to attach said bumper to an upward portion of a rod of a paint roller device so as to establish an angle between the upper section of the main bumper body and the upward portion of the rod rod of at least 30 degrees;

wherein said upper section and said lower section of said main bumper body are located in a single plane and in a straight line and said attachment means are positioned so as to create the aforesaid angle between said upper section of the main bumper body and the upward portion of the rod.

17. The paint roller bumper of claim 16, wherein said angle is at least 45 degrees.

18. The paint roller bumper of claim 16 wherein there are a plurality of attachment means so as to enable attachment of said bumper to an upward portion of a rod of a paint roller device in more than one position.

* * * * *